US009406254B2

(12) United States Patent
Shin et al.

(10) Patent No.: US 9,406,254 B2
(45) Date of Patent: Aug. 2, 2016

(54) DISPLAY DEVICE AND DRIVING METHOD THEREOF

(71) Applicants: SAMSUNG DISPLAY CO., LTD., Yongin, Gyeonggi-Do (KR); Seoul National University R&DB Foundation, Seoul (KR)

(72) Inventors: Dong-Yong Shin, Yongin (KR); Jin-Sung Kim, Asan-si (KR); Joo-Hyuk Yum, Seoul (KR); Hyuk-Jae Lee, Seoul (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 23 days.

(21) Appl. No.: 14/477,174

(22) Filed: Sep. 4, 2014

(65) Prior Publication Data

US 2015/0062198 A1 Mar. 5, 2015

(30) Foreign Application Priority Data

Sep. 5, 2013 (KR) ..... 10-2013-0106531

(51) Int. Cl.

*G09G 5/10* (2006.01)
*G09G 3/20* (2006.01)
*G09G 3/32* (2016.01)

(52) U.S. Cl.

CPC ..... *G09G 3/204* (2013.01); *G09G 3/2025* (2013.01); *G09G 3/3225* (2013.01); *G09G 2320/0266* (2013.01)

(58) Field of Classification Search

CPC ..... G09G 2320/0276; G09G 2360/16; G09G 2320/0626

USPC ..... 345/87–89, 211–213, 690–693

See application file for complete search history.

(56) References Cited

U.S. PATENT DOCUMENTS

| | | | | |
|---|---|---|---|---|
| 7,286,105 | B2 | 10/2007 | Akimoto et al. | |
| 8,212,800 | B2 * | 7/2012 | Ishii | G09G 3/20 345/208 |
| 2008/0111837 | A1 | 5/2008 | Kim et al. | |
| 2008/0170000 | A1 * | 7/2008 | Min | G09G 3/2927 345/60 |
| 2009/0058766 | A1 * | 3/2009 | Choi | G09G 3/2927 345/60 |
| 2011/0001733 | A1 | 1/2011 | Kawabe | |
| 2013/0050305 | A1 * | 2/2013 | Yoshinaga | G09G 3/2022 345/694 |

FOREIGN PATENT DOCUMENTS

| | | |
|---|---|---|
| KR | 10-2008-0042320 | 5/2008 |
| KR | 10-2008-0105269 A | 12/2008 |
| KR | 10-2010-0095568 | 8/2010 |

* cited by examiner

*Primary Examiner* — Kimnhung Nguyen
(74) *Attorney, Agent, or Firm* — Lee & Morse, P.C.

(57) ABSTRACT

A display device includes a timing controller and a data driver. The timing controller to output a first control value including information on low gray scale values, a second control value including information on high gray scale values, and a third control value including information on subfields, corresponding to input data. The data driver to control the gray scale value of a pixel in a plurality of subfields in one frame based on the first, second and third control values. The pixel is driven in an analog manner when the gray scale value based on whether the first or second control value is output, and is driven in a digital manner when the gray scale value corresponds to an emission time during a predetermined subfield among the plurality of subfields.

18 Claims, 3 Drawing Sheets

DISPLAY DEVICE AND DRIVING METHOD THEREOF

CROSS-REFERENCE TO RELATED APPLICATION

Korean Patent Application No. 10-2013-0106531, filed on Sep. 5, 2013, and entitled "Display Device and Driving Method Thereof," is incorporated by reference herein in its entirety.

BACKGROUND

1. Field

One or more embodiments described herein relate to a display device and a driving method.

2. Description of the Related Art

Display devices remain a focus of system designers as information technology continues to develop. Examples of flat panel display devices include liquid crystal display devices (LCDs), organic light emitting display devices (OLEDs), and plasma display panels (PDPs).

SUMMARY

In accordance with one embodiment, a display device includes a timing controller to output a first control value including information on low gray scale values, a second control value including information on high gray scale values, and a third control value including information on subfields, corresponding to input data; and a data driver to control the gray scale value of a pixel in a plurality of subfields in one frame based on the first, second and third control values, wherein the pixel is driven in an analog manner when the gray scale value corresponds to a voltage or is driven in a digital manner when the gray scale value corresponds to an emission time during a predetermined subfield among the plurality of subfields.

The pixel may be driven in the digital manner during subfields other than the predetermined subfield in the one frame. The pixel may be set to a non-emission state in an i-th subfield other than the predetermined subfield and maintains the non-emission state after the i-th subfield, wherein i is a natural number.

Each of the plurality of subfields may be set to a same time. Each of the plurality of subfields may be set to implement j gray scale value(s) when the pixel is driven in the digital manner, wherein j is a natural number. The pixel may be driven in the analog manner when the predetermined subfield implements 0 to j−1 gray scale values.

The timing controller may generate the first control value based on lower bits of the data, may generate the second control value based on upper bits of the data, and may generate the third control value which is increased in the order of "0", "1", "2", . . . , corresponding to the order of the subfields. The data driver may include, in each channel, a controller to control the gray scale value corresponding to the first, second, and third control values.

The controller may include an operator to increase the third control value by 1 when the first control value is 0, and maintain the third control value as a previous number when the first control value is a number different from 0; a comparator to output a signal corresponding to the analog driving when the third control value is 0, and output a signal corresponding to the digital driving when the third control value is different from 0; and an output to generate a first data signal when the gray scale value indicated by the first control value corresponds to an analog driving signal, and to generate a second data signal when the gray scale value of the second control value corresponds to a digital driving signal.

The comparator may output the second data signal corresponding to the non-emission state of the pixel when the third control value is greater than the second control value, and output the second data signal corresponding to the emission state of the pixel when the third control value is not greater than the second control value.

In accordance with another embodiment, a method of driving a display device includes generating a first control value including information on low gray scale values of data, a second control value including information on high gray scale values of the data, and a third control value including subfield information; and controlling the gray scale value of a pixel in a plurality of subfields in one frame based on the first, second and third control values, wherein the pixel is driven in an analog manner when the gray scale value corresponds to a voltage or in a digital manner when the gray scale value corresponds to an emission time during a predetermined subfield among the plurality of subfields.

The pixel may be driven in the digital manner for subfields different from the predetermined subfield. The pixel may be set to a non-emission state in an i-th subfield other than the predetermined subfield and maintains the non-emission state after the i-th subfield, wherein i is a natural number.

Each of the plurality of subfields may be set to a same time. Each of the plurality of subfields may be set to implement j gray scale value(s) when the pixel is driven in the digital manner, wherein j is a natural number. The pixel may be driven in the analog manner during the predetermined subfield implements 0 to j−1 gray scale values.

The first control value may be generated based on lower bits of the data, the second control value may be generated based on upper bits of the data, and the third control value may be increased in the order of "0", "1", "2", . . . , corresponding to the order of the subfields.

Controlling the gray scale value may include increasing the third control value by 1 when the first control value is 0, and maintaining the third control value as a previous value when the first control value is different from 0; determining whether the third control value is 0; driving the pixel in the analog manner during the predetermined subfield, when the third control value is 0; determining whether the third control value is greater than the second control value when the third control value is not 0; and allowing the pixel not to emit light during a corresponding subfield, when the third control value is greater than the second control value, and allowing the pixel to emits light when the third control value is not greater than the second control value.

In accordance with another embodiment, a display device includes a controller to generate a first control signal when a first number of bits of input data lie in a first range of gray scale values and a second control signal when the first number of bits lie in a second range of gray scale values; and a data driver to drive a pixel in a first manner based on the first control signal and to drive the pixel in a second manner based on the second control signal in a predetermined subfield of a frame.

The first manner may correspond to analog driving; the second manner may correspond to digital driving; and the predetermined subfield may be a first subfield of the frame.

BRIEF DESCRIPTION OF THE DRAWINGS

Features will become apparent to those of ordinary skill in the art by describing in detail exemplary embodiments with reference to the attached drawings in which.

DETAILED DESCRIPTION

Figure 1:
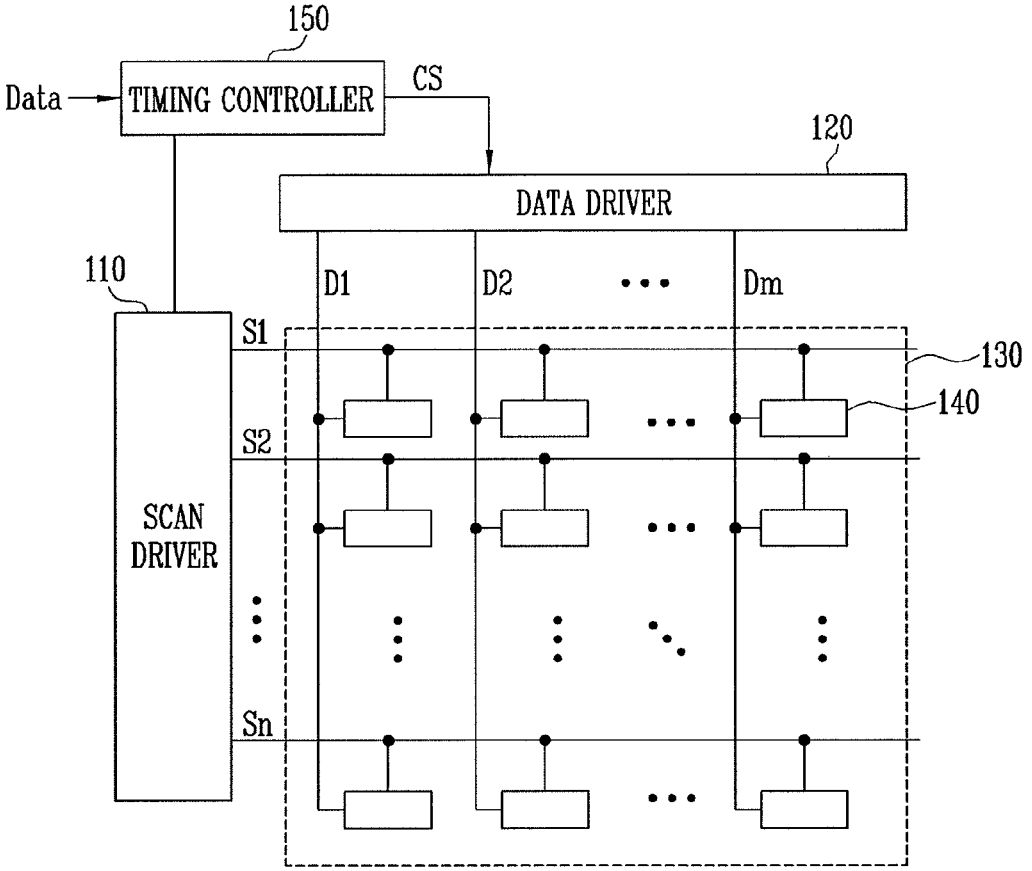
FIG. 1 illustrates an embodiment of a display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. Also, when a first element is described as being coupled to a second element, the first element may be not only directly coupled to the second element but may also be indirectly coupled to the second element via a third element. Further, some of the elements that are not essential to the complete understanding of the invention are omitted for clarity.

FIG. 1 illustrates an embodiment of a display device which includes a scan driver 110, a data driver 120, a pixel unit 130 configured to include pixels 140, and a timing controller 150. The scan driver 110 supplies a scan signal to scan lines S1 to Sn. For example, the scan driver 110 progressively supplies the scan signal to the scan lines S1 to Sn every plural subfields included in one frame.

The timing controller 150 receives data (Data) and a synchronization signal from an external source. The timing controller 150 controls the scan driver 110 and the data driver 120 based on the synchronization signal. Also, the timing controller 150 generates a control signal CS using the Data and supplies the generated control signal CS to the data driver 120. The control signal CS includes a first control value including information on low gray scale values, a second control value including information on high gray scale values, and a third control value including information on one or more subfields in a frame for driving the display device.

The data driver 120 supplies a data signal to data lines D1 to Dm, corresponding to the scan signal during a subfield period. In one embodiment, the data driver 120 supplies a first data signal corresponding to analog driving and a second data signal corresponding to digital driving, corresponding to the first, second, and third control values during a specific or predetermined subfield period in one frame. The data driver 120 supplies the second data signal corresponding to digital driving during the other subfields except the specific or predetermined subfield. To this end, the data driver 120 may include a controller configured to output information on the gray scale value of a subfield corresponding to the first, second and third control values.

The first data signal is set to a specific voltage in a predetermined voltage range corresponding to a gray scale value to be expressed. For example, the first data signal may be set to a specific voltage so that low gray scale values (e.g., gray scale values from s 1 to 63) can be implemented.

The second data signal is set to a voltage corresponding to emission or non-emission of pixel 140. The pixel 140 receiving the second data signal corresponding to the emission is set to an emission state during a corresponding subfield period. The pixel 140 receiving the second data signal corresponding to non-emission is set to a non-emission state during a corresponding subfield period.

The pixel unit 130 includes pixels 140 disposed in matrix form. Each pixel 140 receives the first or second data signal. When the pixel 140 receives the first data signal, the pixel 140 generates light with a luminance corresponding to the voltage of the first data signal during a specific subfield period. The pixel 140 receives the second data signal set to the emission or non-emission state during a corresponding subfield period. In the present embodiment, the pixel 140 may be implemented in various forms, e.g., pixel 140 may be configured to include an organic light emitting diode and a plurality of transistors.

Figure 2:
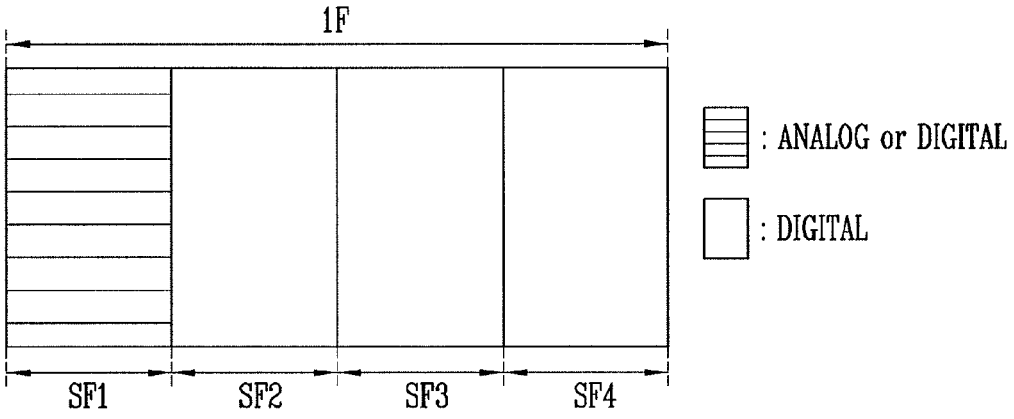
FIG. 2 illustrates an example of a frame that may drive the display device.

FIG. 2 illustrates an example of a frame for driving a display device. The display may be the one illustrated in FIG. 1 or may be a different display device. In this example, the frame includes four subfields SF1 to SF4. A different number of subfields may be included in a frame in other embodiments.

Referring to FIG. 2, the frame 1F is divided into first to fourth subfields SF1 to SF4. The first subfield SF1 is driven in a digital manner or an analog manner, and the second to fourth subfields SF2 to SF4 are driven in the digital manner. In one embodiment, the first to fourth subfields SF1 to SF4 are set to have the same duration. Thus, when the first to fourth subfields SF1 to SF4 are driven in a digital manner, each of the first to fourth subfields SF1 to SF4 implements the same gray scale value. For example, each of the first to fourth subfields SF1 to SF4 may implement 64 gray possible scale values corresponding to emission of the pixel 140. If the subfields SF1 to SF4 implement the same gray scale value, it is possible to reduce false contour noise caused by an emission time difference.

The pixel 140 is set to continuously emit light during the second to fourth subfields SF2 to SF4 when driven in the digital manner. For example, when the pixel 140 is set to the non-emission state in the second subfield SF2, the pixel 140 is also set to the non-emission state in the third and fourth subfield periods SF3 and SF4. Put differently, when pixel 140 is set to the non-emission state in a previous subfield corresponding to subfields SF2 to SF4 driven in the digital manner, the pixel 140 is also set to the non-emission state in a current subfield period that is not the first subfield SF1.

The first subfield SF1 is driven in the analog or digital manner. For example, when driven in the analog manner, the first subfield SF1 implements a gray scale value (e.g., gray scale value of 63 or less) lower than that (e.g., gray scale value of 64) to be expressed when driven in the digital manner. Thus, the pixels 140 receiving the first data signal supplied during the first subfield SF1 generate light with a luminance corresponding to the voltage of the first data signal (e.g., implementation of gray scale values of 0 to 63).

Pixels 140 which receive the second data signal supplied during the first subfield SF1 emit light corresponding to the second data signal. The pixels 140 receiving the second data signal may implement a gray scale value (e.g., gray scale value of 64) higher than that (e.g., gray scale value of 63) to be implemented with the first data signal.

As described above, in the present embodiment, low gray scale values are implemented in the analog manner during the first subfield SF1. As a result, it is possible to minimize the number of subfields SF1 in the frame 1F. This may improve gray scale value expression power. For example, in other display devices, about four subfields are additionally provided to implement low gray scales. Consequently, the supply time (every subfield) of a scan signal contributing to luminance is increased. Therefore, the number of gray scales to be expressed is limited.

Figure 3:
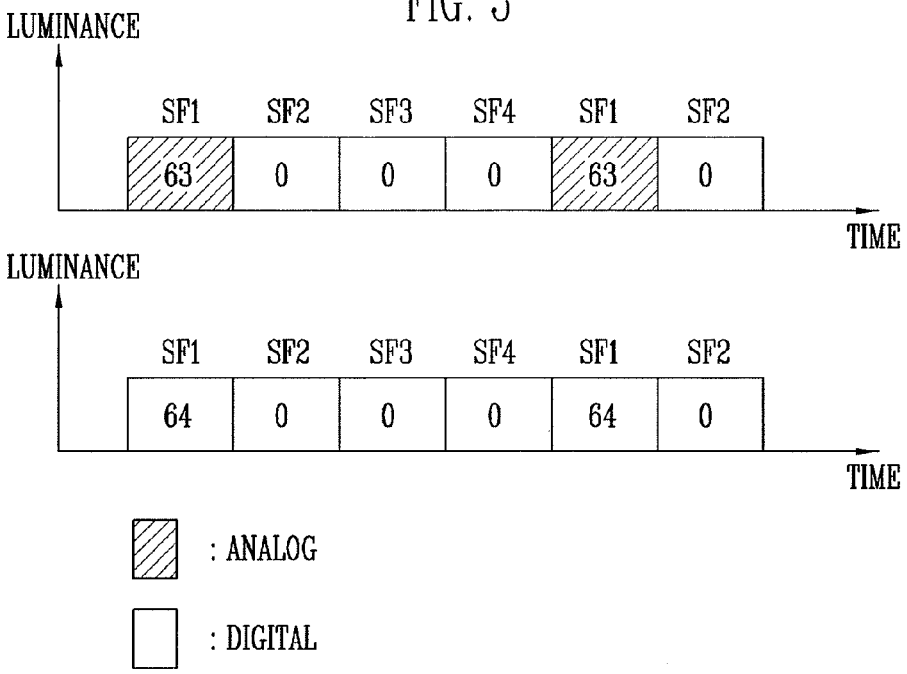
FIG. 3 illustrates an embodiment of gray scale values that may be displayed during a frame period in FIG. 2.

However, in the present embodiment, pixel 140 is driven in the analog or digital manner during the first subfield SF1. Hence, it is possible to minimize false contour noise. In other words, as shown in FIG. 3, a gray scale value of 63 or less (in analog driving) and gray scale value of 64 or more (in digital driving) are expressed during the first subfield SF1. False contour noise caused by an emission time difference is not generated when driven in this way.

Specifically, if one of 63 possible gray scale values are implemented in the first subfield SF1 and a gray scale value of 64 or more is implemented in the second subfield SF2, false contour noise is generated by an emission time difference. However, in the present embodiment, when one of 63 possible gray scale values of the input data is implemented and when gray scale values of the input data in a high range (e.g., gray scale values of 64 or more) are implemented, a gray scale value (e.g., 63+0=63) in this low range is expressed a gray scale value (e.g., 0+64=64) are expressed according to the movement of time. Thus, false contour noise is not generated.

Figure 4:
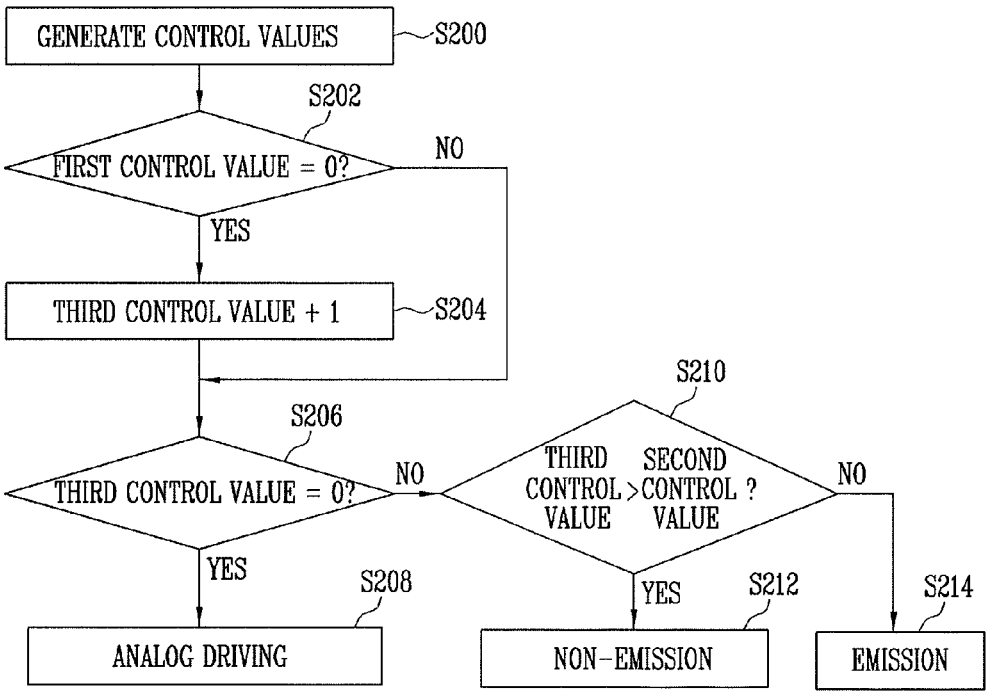
FIG. 4 illustrates an embodiment of a method for driving a display device.

FIG. 4 illustrates operations in an embodiment of a method for driving a display device. The display device may be the one in FIG. 1 or another display device.

Referring to FIG. 4, the timing controller 140 generates first, second, and third control values corresponding to input data (operation S200). The first control value (information on low gray scale values) includes information on gray scale values to be expressed in the analog manner in the first subfield SF1. The second control value (information on high gray scale values) includes information on other gray scale values except the gray scale value in the first control value. The third control value includes information on a subfield to be currently expressed.

If the first control value is not "0" in operation S202, the data driver 120 decides whether the third control value is "0" (operation S206). Similarly, after the third control value is increased by "1" in operation S204, the data driver 120 decides whether the third control value is "0" (operation S206).

If the third control value is "0" in operation S206, a specific pixel is driven in the analog manner corresponding to the information on low gray scale values included in the first control value during the first subfield SF1 (operation S208). In other words, the data driver 120 generates a first data signal corresponding to the first control value. The first data signal is supplied to a specific pixel. Then, the specific pixel implements a predetermined gray scale value while controlling a current value corresponding to the first data signal during the first subfield SF1.

If the third control value is not "0" in operation S206, the data driver 120 decides whether the third control value is greater than the second control value (operation S210). If the third control value is greater than the second control value, the specific pixel is set to a non-emission state during the corresponding subfield period (operation S212). If the third control value is not greater than the second control value in operation S210, the specific pixel is set to an emission state during the corresponding subfield period (operation S214).

As described above, in the present embodiment, the data driver 120 drives the pixels 140 in an analog or digital manner during the first subfield SF1 using the control values supplied from the timing controller 150. The data driver 120 expresses gray scale values while controlling the emission and non-emission of the pixels 140 during the second to fourth subfields SF2 to SF4 using the control values.

In one embodiment, the gray scale values may be implemented as shown in Table 1, which corresponds to the flowchart of FIG. 4.

TABLE 1

| Data | First control value | Second control value | Third control value | SF1 | SF2 | SF3 | SF4 |
|---|---|---|---|---|---|---|---|
| 00111111 (63) | 63 | 0 | 0→1→2→3 | Analog (63) | Non-emission | Non-emission | Non-emission |
| 01000000 (64) | 0 | 1 | 0→1→2→3 | Emission (64) | Non-emission | Non-emission | Non-emission |
| 01000001 (65) | 1 | 1 | 0→1→2→3 | Analog (1) | Emission (64) | Non-emission | Non-emission |
| 10001111 (143) | 15 | 2 | 0→1→2→3 | Analog (15) | Emission (64) | Emission (64) | Non-emission |
| 11000000 (192) | 0 | 3 | 0→1→2→3 | Emission (64) | Emission (64) | Emission (64) | Non-emission |

For example, in a case where input data has 8 bits (i.e., 256 gray possible scale values), the lower 6 bits include information on 63 possible gray scale values. The upper 2 bits include information on 64 or more gray scale values. Thus, in the case where the input data has a value of "00111111", the first control value is set to a gray scale value of 63 and the second control value is set to 0. The third control value is increased in the order of 0 (SF1), 1 (SF2), 2 (SF3) and 3 (SF4), corresponding to the four subfields of FIG. 2.

The control values generated in operation S200 are supplied to the data driver 200. The data driver 120 receiving the control values decides whether the first control value is "0" (operation S202). If it is decided that the first control value is "0" in operation S202, the third control value is increased by "1" (operation S204).

In Table 1, (63), (64), etc., corresponds to gray scale values. In one embodiment, pixels 140 implement gray scale values while being driven in an analog or digital manner during the first subfield SF1. For example, in a case where the first control value of a specific pixel 140 is not "0" during the first subfield SF1 (i.e., has gray scale values in the range of 1 to 63), the specific pixel 140 generates light of a corresponding gray scale value corresponding to the first data signal. The first control value of a specific pixel 140 is set to "0" when the gray scale value in the first subfield SF1 is "0.'

For example, consider the case where Data has a value of 143 corresponding to a binary string of bits of 10001111. The first six bits of Data (which have been underlined for emphasis) is a non-zero value, i.e., 15. The first control value, therefore, will have the value of 15. On the other hand, when the value of Data is 1192 corresponding to a binary string of bits of 11000000, the first six bits of Data is a zero value, i.e., 0. Thus, the first control value will have a value of 0. The first control value, therefore, is used to designate the value of a first number of bits in Data, which bits define a predetermined range of gray scale values, e.g., 0 to 63 in this example embodiment.

In a case where the second control value of the specific pixel 140 has a value of "1" or more, the specific pixel 140 is driven in the digital manner. For example, when a specific pixel 140 implements gray scale values corresponding to Data of "01000000," "10000000," and "11000000," the second control value is set to the emission state corresponding to the second data signal during the first subfield SF1.

Figure 5:
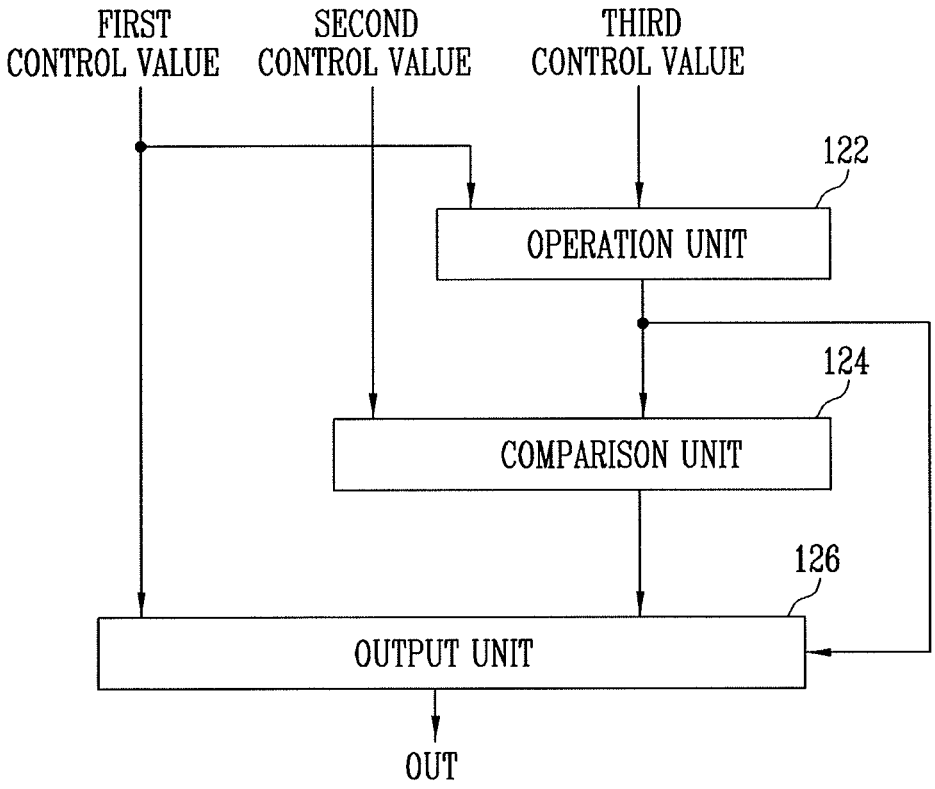
FIG. 5 illustrates an embodiment of a controller in a data driver of the display device.

FIG. 5 illustrates an embodiment of the controller in the data driver. In this embodiment, the controller is positioned in each channel of the data driver to output information of the gray scale value of a subfield.

Referring to FIGS. 4 and 5, the controller includes an operation unit 122, a comparison unit 124, and an output unit 126. The operation unit 122 receives first, second, and third control values from the timing controller 150 (operation S200). Subsequently, the operation unit 122 increases the third control value by "1" when the first control value is "0", and maintains the third control value as it is when the first control value is not "0" (operations S202 and S204).

The comparison unit 124 receives the third control value from the operation unit 122 and receives the second control value from the timing controller 150. The comparison unit 124 outputs a signal corresponding to an analog driving when the third control value is "0" (operations S206 and S208). In this case, the output unit 126 generates a first data signal corresponding to the first control value and supplies the generated first data signal to a corresponding pixel 140.

In a case where the third control value is not "0," the comparison unit 124 compares the third and second control values. For example, the comparison unit 124 outputs a signal corresponding to a non-emission state when the third control value is greater than the second control value. Otherwise, the comparison unit 124 outputs a signal corresponding to an emission state (operations S210, S212, and S214). In this case, the output unit 126 generates a second control signal corresponding to the emission or non-emission state and supplies the generated second data signal to the corresponding pixel 140.

In one or more of the aforementioned embodiments, pixels are driven in subfield SF1 based on the first control value or the second control value. In other embodiments, the pixel may be driven in a subfield different from the first subfield based on these control values. Also, pixels have been indicated to be driven in analog or digital (emission state) manner, or not driven at all (non-emission) based on these values.

By way of summation and review, a flat panel display device is driven in an analog or digital manner. When driven in the analog manner, a predetermined voltage is charged in a pixel and the luminance of the pixel is controlled to correspond to the charged voltage, thereby implementing a gray scale value. However, when driven in the analog manner, it is difficult to implement a uniform gray scale value due to variations of the threshold voltages and mobilities of the transistors in each pixel.

When driven in the digital manner, a voltage corresponding to an emission or non-emission state is charged in the pixel. The emission time of the pixel is controlled corresponding to the charged voltage, thereby implementing a gray scale value. Also, when driven in the digital manner, the voltage corresponding to the emission or non-emission state is supplied to the pixel. Hence, it is possible to implement a uniform gray scale value regardless of differences in the characteristics of the transistors in the pixels. However, when driven in the digital manner, the display quality may be lowered due to false contour noise caused by an emission time difference.

In the display device and the driving method thereof according to the aforementioned embodiments, pixels are driven in the analog or digital manner during a specific subfield period in each frame. For example, during the specific subfield period, a first pixel can implement 63 gray scale values in the analog manner, and a second pixel can implement 64 gray scale values in a digital manner. In this case, false contour noise is not generated by the emission time difference, and it is therefore possible to improve display quality.

Further, low gray scale values are implemented in the analog manner during a specific subfield period. Hence, it is possible to minimize the number of subfields included in the each frame.

The methods and processes described herein may be performed by code or instructions to be executed by a computer, processor, or controller. Because the algorithms that form the basis of the methods are described in detail, the code or instructions for implementing the operations of the method embodiments may transform the computer, processor, or controller into a special-purpose processor for performing the methods described herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, or controller which is to execute the code or instructions for performing the method embodiments described herein.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device, comprising:

a timing controller to output a first control value including information on low gray scale values, a second control value including information on high gray scale values, and a third control value including information on subfields, corresponding to input data; and a data driver to supply a data signal to a pixel and to control a luminance of the pixel in a plurality of subfields in one frame based on the first, second and third control values, wherein:

during a predetermined subfield among the plurality of subfields, the luminance of the pixel is controlled in an analog driving manner that the luminance of the pixel is changed according to a voltage level of the data signal, and during subfields other than the predetermined subfield in the one frame, the luminance of the pixel is controlled in a digital driving manner that the luminance of the pixel is changed according to an emission time of the pixel.

2. The display device as claimed in claim 1, wherein the pixel is set to a non-emission state in an i-th subfield other than the predetermined subfield and maintains the non-emission state after the i-th subfield, wherein i is a natural number.

3. The display device as claimed in claim 1, wherein each of the plurality of subfields is set to a same time.

4. The display device as claimed in claim 1, wherein the pixel receives a first data signal having a j gray scale value when the pixel is controlled in the digital driving manner, wherein j is a natural number.

5. The display device as claimed in claim 4, wherein the pixel receives a second data signal having 0 to j−1 gray scale values when the pixel is controlled in the analog driving manner.

6. The display device as claimed in claim 1, wherein the timing controller:

generates the first control value based on lower bits of the input data, generates the second control value based on upper bits of the input data, and generates the third control value which is increased in the order of "0", "1", "2", . . . , corresponding to the order of the subfields.

7. The display device as claimed in claim 6, wherein the data driver includes a controller to control the luminance of the pixel corresponding to the first, second, and third control values.

8. The display device as claimed in claim 7, wherein the controller includes:

an operator to increase the third control value by 1 when the first control value is 0, and maintain the third control value as a previous number when the first control value is a number different from 0;

a comparator to output a signal corresponding to the analog driving manner when the third control value is 0, and output a signal corresponding to the digital driving manner when the third control value is different from 0; and an output to generate a first data signal when a gray scale value indicated by the first control value corresponds to an analog driving signal, and to generate a second data signal when a gray scale value of the second control value corresponds to a digital driving signal.

9. The display device as claimed in claim 8, wherein the comparator:

outputs the second data signal corresponding to a non-emission state of the pixel when the third control value is greater than the second control value, and outputs the second data signal corresponding to a emission state of the pixel when the third control value is not greater than the second control value.

10. A method of driving a display device, the method comprising:

generating a first control value including information on low gray scale values of data, a second control value including information on high gray scale values of the data, and a third control value including subfield information; and controlling a luminance of a pixel in a plurality of subfields in one frame based on the first, second and third control values, wherein:

during a predetermined subfield among the plurality of subfields, the luminance of the pixel is controlled in an analog driving manner that the luminance of the pixel is changed according to a voltage level of a data signal for the pixel, and during subfields other than the predetermined subfield in the one frame, the luminance of the pixel is controlled in a digital driving manner that the luminance of the pixel is changed according to an emission time of the pixel.

11. The method as claimed in claim 10, wherein the pixel is set to a non-emission state in an i-th subfield other than the predetermined subfield and maintains the non-emission state after the i-th subfield, wherein i is a natural number.

12. The method as claimed in claim 10, wherein each of the plurality of subfields is set to a same time.

13. The method as claimed in claim 10, wherein the pixel receives a first data signal having a j gray scale value when the pixel is controlled in the digital driving manner, wherein j is a natural number.

14. The method as claimed in claim 13, wherein the pixel receives a second data signal having 0 to j−1 gray scale values when the pixel is controlled in the analog driving manner.

15. The method as claimed in claim 10, wherein:

the first control value is generated based on lower bits of the data, the second control value is generated based on upper bits of the data, and the third control value is increased in the order of "0", "1", "2", . . . , corresponding to the order of the subfields.

16. The method as claimed in claim 15, wherein controlling the gray scale value includes:

increasing the third control value by 1 when the first control value is 0, and maintaining the third control value as a previous value when the first control value is different from 0;

determining whether the third control value is 0;

controlling the luminance of the pixel in the analog driving manner during the predetermined subfield, when the third control value is 0;

determining whether the third control value is greater than the second control value when the third control value is not 0; and allowing the pixel not to emit light during a corresponding subfield, when the third control value is greater than the second control value, and allowing the pixel to emits light when the third control value is not greater than the second control value.

17. A display device, comprising:

a controller to generate a first control signal when a first number of bits of input data lie in a first range of gray scale values and a second control signal when the first number of bits lie in a second range of gray scale values; and a data driver to supply a data signal to a pixel and to drive the pixel in a first driving manner based on the first control signal in a first subfield of a frame and to drive the pixel in a second driving manner based on the second control signal in a second subfield of the frame, wherein:

in the first driving manner, a luminance of the pixel is changed according to a voltage level of the data signal, and in the second driving manner, the luminance of the pixel is changed according to an emission time of the pixel.

18. The display device as claimed in claim 17, wherein:

the first driving manner corresponds to analog driving; and the second driving manner corresponds to digital driving.

* * * * *